US005941383A

United States Patent [19]

Cheng

[11] Patent Number: 5,941,383

[45] Date of Patent: Aug. 24, 1999

[54] COLLAPSIBLE GOLF BAG

[76] Inventor: Jeremy Cheng, 328 Shing An Rd., Ta-An Shiang,Taichung, Taiwan

[21] Appl. No.: 09/138,908

[22] Filed: Aug. 24, 1998

[51] Int. Cl.[6] ..... A63B 55/00

[52] U.S. Cl. ..... 206/315.8; 206/315.3; 206/315.7

[58] Field of Search ..... 206/315.7, 315.3, 206/315.8; 220/9.2

[56] References Cited

U.S. PATENT DOCUMENTS

| | | | |
|---|---|---|---|
| 1,488,389 | 3/1924 | Hibbert | 206/315.7 |
| 1,658,243 | 2/1928 | Kindwall | 206/315.8 |
| 1,826,216 | 10/1931 | Johnson | 206/325.8 |
| 2,435,479 | 2/1948 | Thommen | 206/315.8 |
| 4,071,062 | 1/1978 | Ianetta | 206/315.7 |
| 4,378,039 | 3/1983 | Suk | 206/315.8 |
| 4,635,793 | 1/1987 | Kim | 206/315.7 X |
| 4,865,192 | 9/1989 | Williams | 206/315.8 X |
| 4,967,904 | 11/1990 | Quellais et al. | 206/315.3 |
| 5,178,273 | 1/1993 | Igarashi | 206/315.8 X |
| 5,445,267 | 8/1995 | Biafore, Jr. | 206/315.8 |
| 5,482,160 | 1/1996 | Perrin | 206/315.8 |
| 5,528,813 | 6/1996 | Biafore, Jr. | 206/315.8 X |
| 5,638,954 | 6/1997 | Hsien | 206/315.8 |
| 5,725,095 | 3/1998 | Beck et al. | 206/315.8 |
| 5,769,220 | 6/1998 | Hong | 206/315.8 X |
| 5,788,071 | 8/1998 | Shiao | 206/315.8 |

FOREIGN PATENT DOCUMENTS

| | | | |
|---|---|---|---|
| 473388 | 10/1937 | United Kingdom | 206/315.7 |

*Primary Examiner*—Sue A. Weaver
*Attorney, Agent, or Firm*—Coats & Bennett, PLLC

[57] ABSTRACT

A collapsible bag includes a base and an upper frame. A series of support rods are interconnected between the upper frame and the base. To secure the support rods within the golf bag, there is provided a retainer about the base that receives a slideable retaining cap. The slideable retaining cap is inserted within the retainer and engages a respective support rod that projects through an opening in the base. Thus the support rods are retained within the golf bag by the retaining caps that are inserted within the retainers.

17 Claims, 5 Drawing Sheets

COLLAPSIBLE GOLF BAG

FIELD OF THE INVENTION

The present invention relates to collapsible golf bag constructions and methods for assembling such golf bags.

BACKGROUND OF THE INVENTION

Collapsible golf bags have considerable utility in that they are readily collapsed for shipping from the factory to a retailer or final user to be thereafter assembled into the conventional generally tubular elongated golf bag. Known collapsible golf bags typically include a plastic upper frame and a plastic base attached to opposite ends of a golf bag jacket of flexible material so as to form a generally tubular container open at its top to receive various golf clubs. The upper frame and base member are typically held apart, and the golf bag jacket is held taunt, by support rods where one end of the rods abut the top member and the distal end of the rods abut the base. The rods typically are at least partially contained by portions of the flexible material of the golf bag jacket.

Examples of existing collapsible golf bags are shown in U.S. Pat. Nos. 4,378,039 to Suk; 4,967,904 to Quellais et al.; 5,528,813 to Biafore; 5,725,095 to Beck et al.; and 5,638,954 to Hsien.

The Hsien patent, in particular, shows a collapsible golf bag wherein the upper frame member and base are held apart by a plurality of removable hollow support rods. The hollow support rods fit into support holes in the upper frame member and are supported from underneath by a corresponding plurality of screw elements tightly screwed into the base. Assembly of the Hsien device requires the use of tools, such as relatively large screwdrivers, to properly install the hollow support rods with the screw elements. The Hsien assembly process is time consuming due to the complexity of the screwing operation. Further, re-collapsing the golf bag, such as for storage in the trunk of a car by the user, is likewise a time consuming process requiring the use of tools.

Therefore, there remains a need for a collapsible golf bag that can be readily assembled, preferably without the use of tools. Further, it is desirable, but not required, that such a golf bag be readily re-collapsible without the use of tools.

SUMMARY OF THE INVENTION

The collapsible golf bag of the present invention includes a base and an upper frame attached to opposite ends of a golf bag jacket and separated by at least one, and preferably a plurality of support rods. The support rods, which are preferably in a compressed condition, are retained in position by retaining caps which slide between a primed position and a locked position to allow for the assembly and disassembly of the golf bag without the use of tools. With the retaining caps in the primed position, the support rods are inserted through the base and engaged by suitable portions of the upper frame. Thereafter, the retaining caps are moved to the locked position. In the locked position, the retaining caps vertically engage both the base and the corresponding end of the support rod and thereby limit the vertical movement of the support rod with respect to the base. In effect, the support rods are trapped between the upper frame and the retaining cap, which is in turn trapped by the base. In this assembled condition, the upper frame is held away from the base by the support rods and the golf bag jacket is preferably taunt, thereby presenting a traditional golf bag appearance.

In one preferred embodiment, the base includes retaining bays corresponding in number to the number of support rods. The retaining bays each include a rail designed to engage corresponding retaining caps, preferably by grasping a pair of sliding flanges on the retaining cap. On the top of each retaining cap is recess for engaging the support rod. The retaining cap is moved between the primed position and the locked position by sliding the retaining cap within the retaining bay. In the locked position, the recess engages the support rod so as to limit its vertical movement and the support rod, by virtue of its being engaged by the recess, limits the horizontal movement of the retaining cap, keeping the retaining cap in the locked position.

To re-collapse the golf bag of one preferred embodiment, the end of the support rod is pulled out of engagement with the recess, thereby freeing the retaining cap to be returned to the primed position. With the retaining cap in the primed position, the support rods can be removed, allowing the golf bag jacket to be folded to facilitate packaging or carrying. The sliding of the retaining cap between the primed position and the locked position may be accomplished manually, optionally without the use of tools.

DETAILED DESCRIPTION

Figure 1:
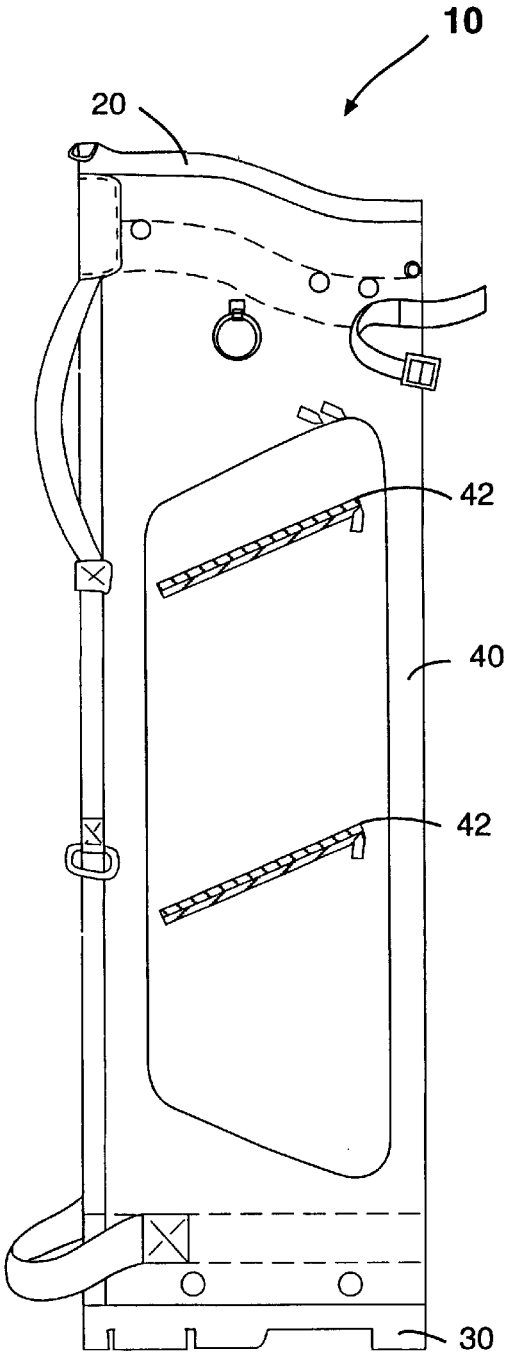
FIG. 1 is a side view of one embodiment of the collapsible golf bag of the present invention in its assembled state.
Figure 2:
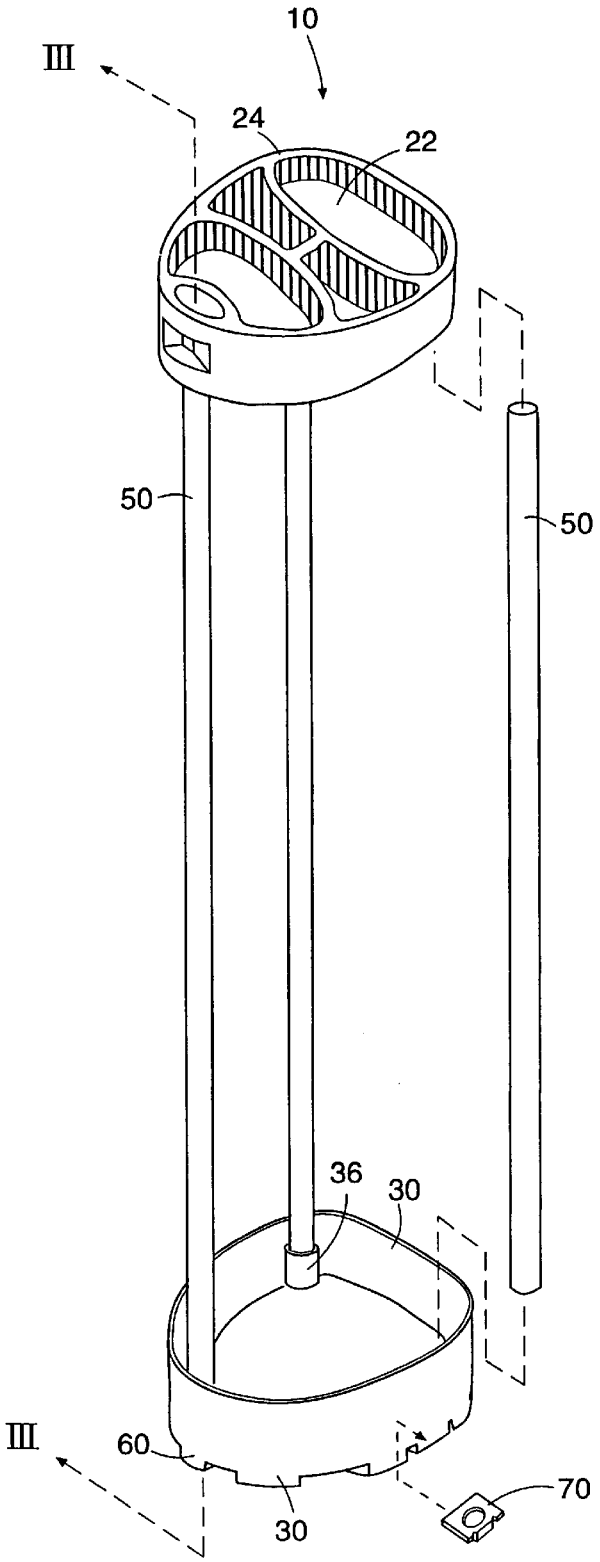
FIG. 2 is a partially exploded perspective view of one embodiment of a collapsible golf bag of the present invention with the golf bag jacket removed.
Figure 3:
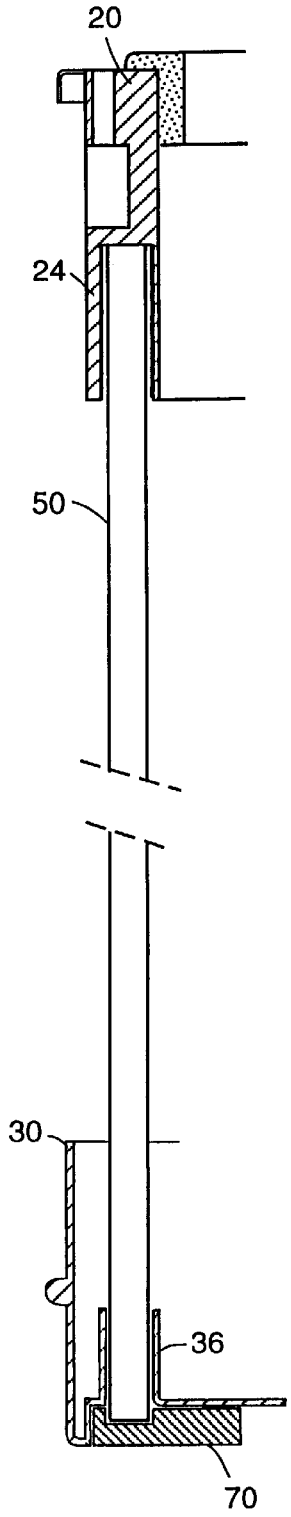
FIG. 3 is partial sectional view along line III—III of FIG. 2.

With reference to FIGS. 1–4, the collapsible golf bag 10 of the present invention includes an upper frame 20 and a base 30 attached to opposite ends of a generally tubular golf bag jacket 40. The golf bag jacket 40 is typically made from flexible material such as nylon or cotton fabric and may have numerous pockets 42 thereon as is well known in the art. The upper frame 20 and base 30 are joined to the golf bag jacket 40 by any method well known in the art, such as by stitching, riveting, gluing, or the like. To camouflage possible rough edges of the upper and lower ends of the golf bag jacket 40, the edges are typically folded and separate cuffs (not shown) are usually aligned and then attached to the golf bag jacket 40 and the upper frame 20 and base 30 of the golf bag 10.

Further interconnecting the upper frame 20 and the base 30 is at least one, and preferably a plurality of, support rods 50. The support rods 50 keep the upper frame 20 and the base 30 separated, thereby allowing the collapsible golf bag 10 to assume a generally tubular shape as shown in FIG. 1. Preferably, the support rods 50 are routed through suitable portions of the golf bag jacket 40 so as to be substantially isolated from any golf clubs being carried in the golf bag 10. Further, the support rods 50 are preferably compressed into a slightly deflected shape, such as a gentle bow shape, so as to provide appropriate spring force to keep the upper frame 20 and the base 30 separated and the golf bag jacket 40 taunt during normal use. The support rods 50 may have round, square, hexagonal, or any other cross section, including variable cross sections. The support rods 50 may be made from any suitably stiff material well known in the art, such as aluminum, steel, wood, fiberglass, or the like and may be of one or multiple piece construction.

The upper frame 20 preferably includes a plurality of openings 22 for insertion of golf clubs therethrough. On the underside of the upper frame 20, near its periphery, are a plurality of hollow support columns 24 protruding downwardly from the upper frame 20 at suitable positions for engaging the corresponding support rods 50.

The base 30 includes a plurality of feet 31, drain holes 32, and braces 33 which perform their standard functions. In addition, the periphery of the inner upper side of the base 30 includes one, and preferably a plurality of, hollow guide collars 36 protruding upwardly from the interior of the base 30, corresponding to the hollow support columns 24 of the upper frame 20 in number, for engaging the support rods 50. Associated with each guide collar 36, on the lower side of the base 30, is a retainer or retaining bay 60, shown in FIG. 3 and FIG. 4, for engaging a retaining cap or tab 70. Each retaining bay 60 is preferably rectangular in shape and enclosed on at least two opposing sides by walls 62 having an L-shaped cross-section. For clarity, these walls will be called rails 62. On the lower portion of the retaining bay 60, between the rails 62, there is optionally a generally rectangular slot 64. On the upper portion of the retaining bay 60 is a hole 66 leading to the corresponding guide collar 36. This hole 66 should be of a shape corresponding to the cross section of the lower end of the support rod 50 and of just slightly larger size to allow a sliding fit thereof. Preferably, the height of the retaining bay 60 is smaller than the height of the feet 31 so that the weight of the golf bag in its normal upright orientation is primarily borne by the feet 31.

Figure 5A:
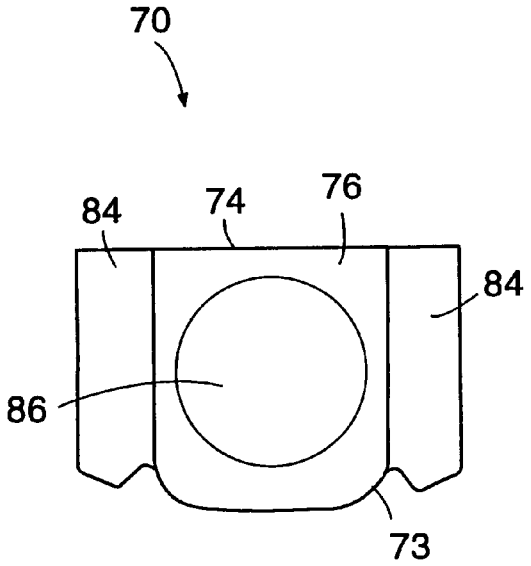
FIG. 5A is a top view of one embodiment of the retaining cap.
Figure 5B:
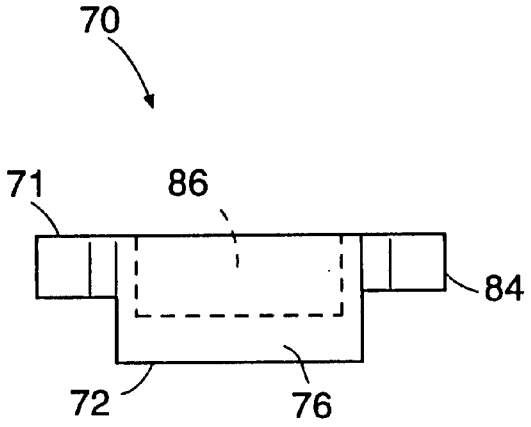
FIG. 5B is a front side top view of the retaining cap of FIG. 5A.

Referring to FIGS. 5A and 5B, the retaining cap 70 has a top 71, a bottom 72, a front edge 73, and a rear edge 74 and includes a center section 76 and a pair of flanges 84. On the top 71 of the center section 76 is a recess 86 sized to accept the end of a support rod 50. The retaining cap 70 is preferably sized to be a flush fit when mated to the retaining bay 60 such that the bottom 72 of the center section 76 is flush with the lower portion of the rails 62 and the rear edge 74 is flush with the corresponding ends of the rails 62. To aid in insertion of the retaining cap 70 into the retaining bay 60, it is preferred that the leading edges of the flanges 84 and the center section 76 be slightly chamfered or rounded.

Figure 4:
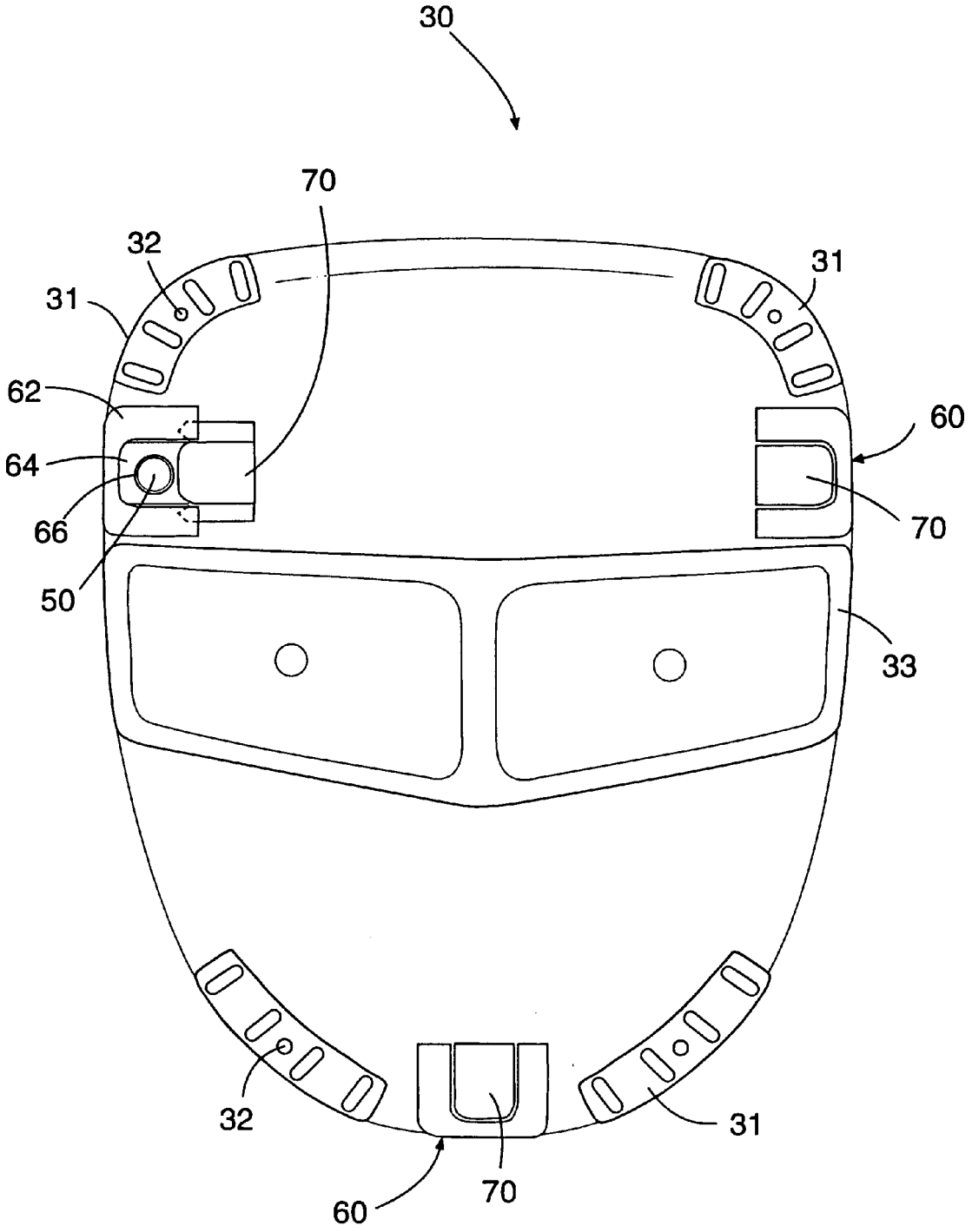
FIG. 4 is a bottom view of the base with two retaining caps in their locked position and one retaining cap in its primed position.

To assemble the collapsible golf bag 10, the support rods 50 are fed through the holes 66 in the retaining bay 60 of the base 30, through the guide collars 36, and up into the hollow support columns 24 of the upper frame 20. Thereafter, the retaining cap 70 is partially inserted into the retaining bay 60 to a primed position by sliding the flanges 84 of the retaining cap 70 between the rails 62 and the rest of the base 30 as shown in FIG. 4. In this primed position, the lower end of the support rod 50 is exposed. The end of the support rod 50 is then retracted into the hole 66 by, for example, the assembler pushing against the end of the support rod 50 or otherwise bending the support rod 50. This action extends the golf bag jacket 40 to a taunt position and slightly spring loads the support rod 50. The retaining cap 70 is then slid the rest of the way into the retaining bay 60 so that the retaining cap 70 assumes a locked position. When the recess 86 lines up with the end of the support rod 50, the support rod 50 should spring into engagement with the recess 86. A similar procedure is followed for the remaining support rods 50 and retaining caps 70.

In the locked position, the retaining cap 70 holds the support rod 50 in proper position, preventing the support rod 50 from falling out the bottom 72 of the base 30. In essence, each support rod 50 is trapped between the corresponding hollow support column 24 of the upper frame 20 and the retaining cap 70. The retaining cap 70 is in turn held in place by the rails 62 of the base 30 and the support rod 50. The rails 62 of the base 30 prevent vertical movement of the retaining cap 70. Because the support rod 50 extends through the hole 66 and into the recess 86 of the retaining cap 70, the support rod 50 prevents the horizontal movement of the retaining cap 70. Thus, the retaining cap 70 is trapped in its locked position, and prevented from returning to its primed position, by the support rod 50.

To re-collapse the golf bag 10, the retaining cap 70 must be released from the locked position. To do so, the support rod 50 is pulled back from engagement with the recess 86. A simple method of pulling back the support rod 50 is for the user to directly or indirectly pull the support rod 50 so as to temporarily induce a larger bend therein, preferably with the golf bag 10 upside down. With the support rod 50 pulled out of engagement with the recess 86, the retaining cap 70 is freed to be slid back into its primed position, thereby allowing the support rod 50 to be removed. A similar procedure is followed for the remaining support rods 50 and retaining caps 70 until all the support rods 50 are removed. Without the support of the support rods 50, the golf bag jacket 40 should collapse. The golf bag 10 may then be folded to facilitate packaging or carrying.

As shown above, the collapsible golf bag 10 of the present invention may be readily assembled, preferably without the use of tools. Further, the golf bag 10 is optionally readily re-collapsible without the use of tools.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A collapsible golf bag, comprising:

a) an upper frame;

b) a base;

c) at least one support rod having a longitudinal axis and extending between the upper frame and base for generally maintaining the upper frame and base in spaced apart relationship;

d) the base including an opening through which a lower portion of the support rod extends;

e) a retainer disposed adjacent the opening formed in the base and including an open side that opens in a direction perpendicular to the longitudinal axis; and f) a laterally sliding retaining cap that is movable laterally through the open side of the retainer into the retainer so as to form a retained relationship between the retainer and the retaining cap and for securing the support rod within the base.

2. The golf bag of claim 1 wherein said support rod engages said retaining cap when said retaining cap forms a retained relationship with the retainer.

3. The golf bag of claim 1 further including a golf jacket connected between said base and said upper frame.

4. The golf bag of claim 1 wherein said retaining cap includes a pair of flanges and said retainer includes at least one rail for engaging said flanges.

5. The golf bag of claim 1 wherein said retaining cap engages said support rod so as to prevent said support rod's movement below said base.

6. The golf bag of claim 1 wherein said retaining cap has a top and a bottom and wherein said top includes a recess and wherein said recess engages said support rod when the retaining cap assumes an inserted position within the retainer.

7. The golf bag of claim 6 wherein said recess is generally circular.

8. The golf bag of claim 1 wherein said support rod is of one-piece construction.

9. The collapsible golf bag of claim 1 wherein said retaining cap is slideable back and forth into and out of the retainer and wherein when the retaining cap moves back and forth into and out of the retainer it is generally moving normal to the longitudinal axis of the support rod.

10. The collapsible golf bag of claim 9 wherein when the retaining cap is moved into the retainer, the retaining cap engages a lower end portion of the support rod and prevents the support rod from falling through the base of the golf bag.

11. The collapsible golf bag of claim 10 wherein the retaining cap includes a recessed seat that receives and retains the lower end portion of the support rod therein when the retaining cap forms the retained relationship with the retainer.

12. The collapsible golf bag of claim 11 wherein the recessed seat includes a generally round opening formed in a top portion of the retaining cap and wherein the round opening receives and holds the lower end portion of the support rod.

13. The collapsible golf bag of claim 1 wherein the retainer comprises a pair of spaced apart rails disposed adjacent to the opening formed in the base and spaced relative to the base so as to form an opening between each rail and the base; and wherein the retaining cap includes a pair of spaced apart flanges that are adapted to be inserted between the rails and the base such that when the retaining cap is laterally inserted through the side opening of the retainer, the flanges are held and retained by the retainer.

14. The collapsible golf bag of claim 13 wherein the retaining cap includes a seat for receiving and holding the support rod and wherein the seat is formed on a top portion of the retaining cap and when the support rod is received within the golf bag the support rod projects through the opening within the base and engages and seats within the retaining cap.

15. The collapsible golf bag of claim 13 wherein the retainer assumes a generally u-shaped configuration.

16. The collapsible golf bag of claim 13 wherein the retaining cap engages and supports the lower end portion of the support rod when the retaining cap is inserted within the retainer such that the support rod is caused to be generally compressed between the upper frame and the retaining cap.

17. A collapsible golf bag comprising:

a) an upper frame;

b) a base including a bottom and a plurality of openings formed within the bottom of the base;

c) a series of support rods extending between the upper frame and the base and wherein each of the support rods includes a lower end portion that is adapted to project generally downwardly through an opening within the bottom of the base;

d) a series of retainers secured to the base adjacent to the respective openings formed in the bottom of the base, each retainer including a pair of spaced apart side rails that are also spaced with respect to the bottom of the base so as to form an opening between each side rail and the bottom of the base;

e) each retainer including an open side that permits a lateral entry into the retainer and into the space between the side rails of the retainer and the bottom of the base;

f) a series of retaining caps that are adapted to slide laterally into and out of the retainers and to engage the lower end portion of the respective support rods so as to prevent the support rods from falling through the base of the collapsible golf bag, each retaining cap including a pair of opposed flanges and having a top portion with a recessed seat formed therein, the recessed seat being adapted to receive and hold the lower end portion of a respective support rod when the retaining cap is inserted with a respective retainer, and wherein when the retaining of caps assume an inserted position within the retainers, the respective support rods project down and engage the recessed seat of the respective retaining caps such that the support rods are securely held within the collapsible golf bag.

* * * * *